US006267475B1

(12) United States Patent
Lee et al.

(10) Patent No.: US 6,267,475 B1
(45) Date of Patent: Jul. 31, 2001

(54) PRINTER INK SUPPLY SYSTEM

(75) Inventors: Ted Tuern Lee; Juan Carlos Vives, both of San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/514,069

(22) Filed: Feb. 26, 2000

(51) Int. Cl.[7] ..... M41J 2/175
(52) U.S. Cl. ..... 347/86; 401/34
(58) Field of Search ..... 347/49, 85, 86; 401/34, 35, 57

(56) References Cited

U.S. PATENT DOCUMENTS

| | | | | |
|---|---|---|---|---|
| 5,044,804 | * | 9/1991 | Chuang | 401/34 |
| 5,057,854 | | 10/1991 | Pond et al. | 347/42 |
| 5,376,958 | | 12/1994 | Richtsmeier et al. | 347/40 |
| 5,686,947 | | 11/1997 | Murray et al. | 347/85 |
| 5,844,579 | | 12/1998 | Barinaga et al. | 347/7 |
| 5,872,580 | | 2/1999 | Ochi et al. | 347/40 |
| 5,975,677 | | 11/1999 | Marler et al. | 347/40 |
| 5,984,450 | | 11/1999 | Becker et al. | 347/24 |

* cited by examiner

*Primary Examiner*—N. Le
*Assistant Examiner*—Anh T. N. Vo

(57) ABSTRACT

A printer ink supply system that includes a docking station having a pair of separated keying members and another docking station having another pair of separated keying members, wherein the docking station and the other docking station can be arranged in a stacked relationship when one of the keying members on the docking station is interlocked with a keying member on the other docking station. The keying members are distributed on the top, bottom and side walls of both docking stations thereby enabling the two to be interlocked in top to bottom or side to side relationships. The docking stations are interchangeable and any number can be joined in vertical or horizontal relationships, or in combinations of vertical and horizontal relationships.

13 Claims, 1 Drawing Sheet

PRINTER INK SUPPLY SYSTEM

BACKGROUND OF THE INVENTION

The present invention relates generally to ink-jet printing and, more particularly, to a technique for modifying the number of ink containing reservoirs to suit printer requirements.

A typical ink-jet printer includes a printhead mounted to a carriage that is moved back and forth across print media, such as paper for example. As the printhead moves across the print media, a control system activates the printhead to deposit or eject ink droplets onto the print media to form desired images and characters.

Some ink-jet printers utilize ink supplies that are not mounted to the carriage. Such ink supplies, because they are stationary within the printer, are not subject to the size limitations of the carriage-mounted ink supply and as a result, can hold a substantially greater ink volume. Some printers with stationary ink supply systems utilize replaceable ink reservoirs. These reservoirs are not carriage mounted and thus are not moved with the printhead during printing. In some cases, a printhead pen is mounted on the carriage and the pen is fluidly coupled to the ink containing reservoirs that supply ink to the printhead. (Those skilled in the art will realize that while the term "pen" is used, the term is not intended to refer to a device that actually contacts the media, such as paper.)

Some printers utilize an ink supply system comprising a single reservoir while others, used in industrial applications for mail addresses or bar code printing, for example, can have between one and six ink reservoirs. In other cases, reservoirs containing black, cyan, magenta and yellow colorants are found in a single printer. In addition to the complications introduced by the varying numbers of reservoirs, complicating the picture still further is the fact the architecture of one printer may differ substantially from that of another. In this regard, for example, the reservoirs may be stacked vertically in one printer and in side by side relationship in another. Moreover, in some cases, the reservoirs may be stacked both vertically and in side by side relationships.

The prior art solution to the complexities presented by differing numbers of reservoirs from one printer to the next, and differing printer architectures, is to require a reservoir support system tailored to the requirements of a specific printer. Such an approach is wasteful and can require printer manufacturers to maintain an inventory of different reservoir support systems in order to accommodate different printers. In addition, it requires manufacturers of OEM (original equipment manufacture) to maintain an ink supply inventory of varying shapes and sizes, in order to accommodate the variety of differing printer requirements in the modem marketplace.

From the foregoing it will be apparent that there is a need for a technique for a printer ink supply system that is simple to construct and is sufficiently flexible to have utility for a broad spectrum of printers having differing architectures. Desirably, such a technique would give an OEM manufacturer the capability of meeting a variety of different printer ink supply needs without requiring an inventory of differing printer ink supplies.

DISCLOSURE OF THE INVENTION

According to the present invention there is provided a printer ink supply system that includes a docking station having a pair of separated keying members and another docking station having another pair of separated keying members, wherein the docking station and the other docking station can be arranged in a stacked relationship when one of the keying members on the docking station is interlocked with a keying member on the other docking station. The keying members are distributed on the top, bottom and side walls of both docking stations thereby enabling the two to be interlocked in top to bottom or side to side relationships. The docking stations are interchangeable and any number can be joined in vertical or horizontal relationships, or in combinations of vertical and horizontal relationships.

The printer ink supply system of the present invention affords several distinct advantages. Since the docking stations are interchangeable, any suitable stacking can be accomplished to satisfy the different needs among ink printers. Thus, a majority of printers requiring different numbers of ink supplies can now use the stackable docking stations of the present invention to match the desired number and stacked configuration of individual printers. In this regard, the stackable ink supply docking stations of the present invention save time and costs since the need for developing new ink supply systems for new printers has been substantially eliminated. In addition, since the docking stations are interchangeable, the OEM manufacturer is required to maintain an inventory only of individual docking stations.

Another advantage of the present invention is that, in some cases, the capability of stacking ink supply docking stations vertically can provide the gravity height required by some printers to support adequate ink flow.

Other aspects and advantages of the present invention will become apparent from the following detailed description, taken in conjunction with the accompanying drawings, illustrating by way of example the principles of the invention.

BEST MODE FOR CARRYING OUT THE INVENTION

The docking, station 10, depicted in the several drawings, is constructed so that it is capable of being interlocked, in a variety of relationships, with identical other docking stations. In this regard, since the docking station 10 is interchangeable with counterparts, stacked ink supply stations are possible, such as the interlocked stations shown in FIGS. 3–5. Those skilled in the art will realize that the stacked relationships shown in these figures are exemplary and do not in any manner exhaust the variety of stacked relationships made possible by the present invention.

Figure 1:
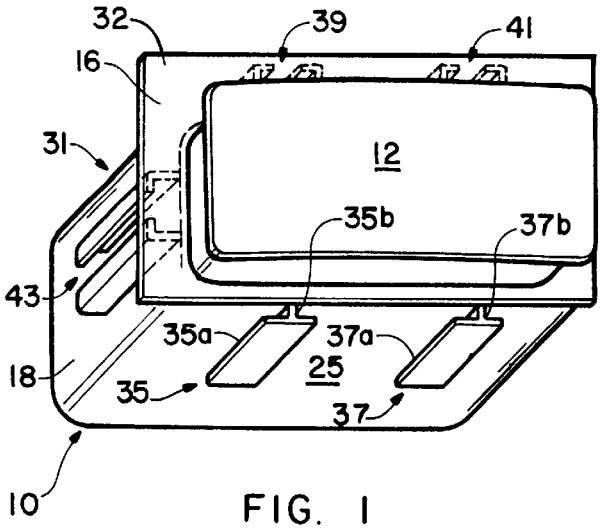
FIG. 1 is a perspective view of a docking station constructed according to the present invention, showing the top, front and a side wall thereof.
Figure 2:
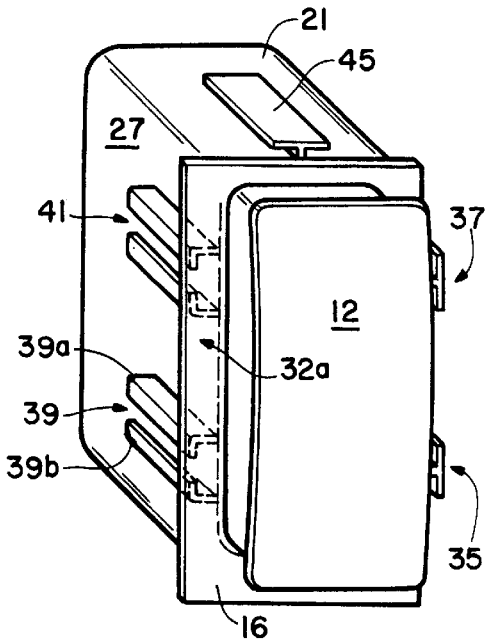
FIG. 2 is a perspective view of the docking station of FIG. 1 showing the bottom, front and another side wall thereof.

Referring now to FIGS. 1 and 2 of the drawings, there are shown a docking station 10 that is constructed according to the present invention. The docking station 10 is box-like in construction and is adapted for receiving and holding securely an ink supply reservoir, such as the reservoir 12. The docking station 10 includes a front wall 16, top and bottom walls, 18 and 21, respectively, a left sidewall 25 and a right sidewall 27.

Keying members that enable interlocking the docking station 10 with a counterpart, are attached to the top and bottom walls 18 and 21, respectively, and the to left and right side walls, 25 and 27, respectively. Each keying member is one of two complementary configurations. In one configuration, the keying member, of which keying members shown generally at 35 and 37, on the left side wall 25, are exemplary. The keying members 35 and 37 are elongated and T-shaped in section. Each includes a leg, 35*b* and 37*b*, respectively, fixed at an end to the sidewall 25 and, at an opposite end, to plates 35*a* and 37*a*, respectively. As shown in FIG. 2, a T-shaped keying member 45, identical to the T-shaped members 35 and 37, is attached to the bottom wall 21.

Complementary to the T-shaped members 35, 37 and 45 are keying member receivers such as the keying member receivers shown generally at 41, 39 and 43. As shown in FIG. 1, the keying member receiver 43 is attached to the docking station 10 top wall 18, while the keying member receivers 39 and 41 are attached to the right side wall 27 (FIG. 2). Each keying member receiver, of which the receiver 39 is exemplary, is channel-like in construction, having a pair of spaced apart elongated lipped walls, such as the walls 39*a* and 39*b*. Each keying member receiver, such as the keying member receiver 39 is sized to receive, and releasably retain, a complementary T-shaped member, such as the member 35. In a similar manner, the keying member receivers 43 and 45 are complementary to the T-shaped members 45 and 37, respectively.

It will be noted, with reference to FIGS. 1 and 2, that the T-shaped keying members, of which 43 and 45 are exemplary, are mounted on their respective walls nearer the front wall 16 than to a back wall (not shown). Thus, for example, when a user desires to interlock docking stations to form a top to bottom stack, the user simply slides one docking station 10 back to front relative to the other station so that the T-shaped member 45 of one docking station 10 is engaged by and slides along the keying member receiver 43 of the second docking station 10. In order to align the interlocked docking stations, the front wall 16 includes stops, generally shown at 31 in FIG. 1 and at 32*a* in FIG. 2, that serve to limit forward movement of one docking station 10 in relation to the other docking station.

Figure 5:
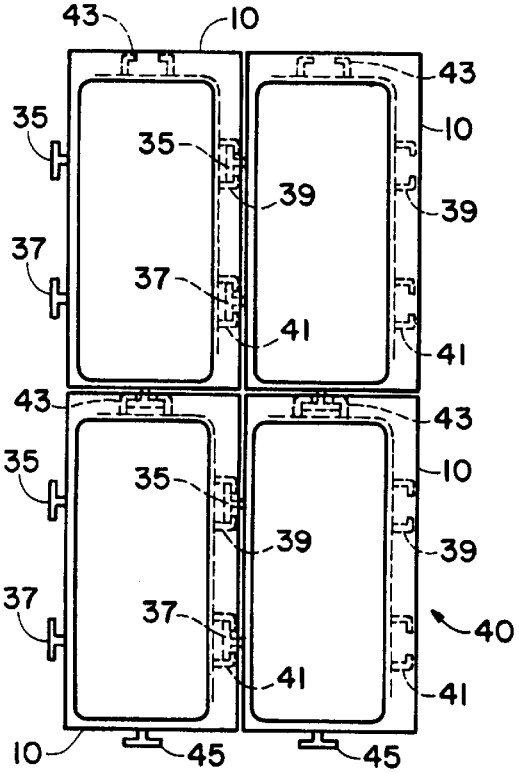
FIG. 5 is a schematic plan view showing docking stations of the present invention interlocked in both side by side and top to bottom relationships.
Figure 3:
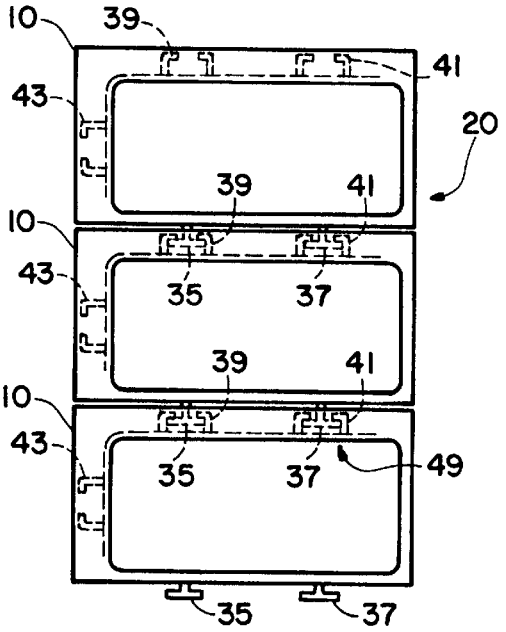
FIG. 3 is a schematic plan view showing docking stations of the present invention interlocked in side by side relationships.
Figure 4:
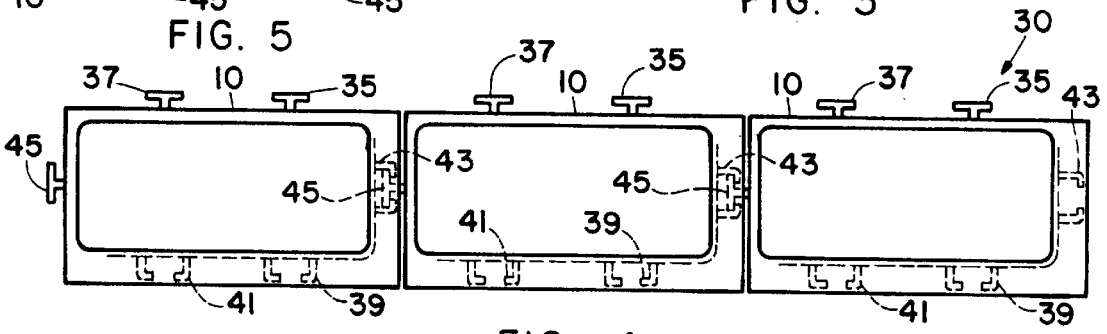
FIG. 4 is a schematic plan view showing docking stations of the present invention interlocked in top to bottom relationships.

With reference now to FIGS. 3 through 5, there are shown three exemplary techniques of stacking the docking stations 10 in interlocking relationships. In FIG. 3, there is shown a stack 20 wherein the docking stations are interlocked in side by side relationships. In each case, the T-shaped members 35 and 37 are releasably retained within the keying member receivers 39 and 41, respectively, in a manner shown generally by the reference numeral 49. It will be readily understood by those skilled in the art that while three docking stations 10 are shown, side by side stacking of fewer, or more, stations are within the scope of the present invention.

Referring now to FIG. 4, there is shown a stack 30 in which the docking stations 10 are interlocked in top to bottom relationships wherein the T-shaped members 45 are received and releasably retained by the keying member receivers 43. As stated above, the present invention is not limited to the number of docking stations 10, or to the interrelationships of the stations 10, as shown in the stack 30.

In FIG. 5, there is shown a docking supply station stack 40 in which the docking stations 10 are interlocked, in the manner described with respect to FIGS. 2 and 3. It will be noted that the docking stations are interlocked in top to bottom relationships and in side to side relationships. Once again, the stack 40 is exemplary and not intended to limit neither the number nor the relationships among and between the docking stations 10 in a stack.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A printer ink supply system, comprising:

a docking station having a pair of sidewalls, a top wall and a bottom wall, said top wall and said bottom wall each including a keying member; and another docking station having a pair of sidewalls, a top wall and a bottom wall, said top wall and said bottom wall each including a keying member, wherein said docking station and said another docking station can be arranged in a stacked relationship when said docking station bottom wall keying member is interlocked with said another docking station top wall keying member.

2. The printer ink supply system according to claim 1, including a keying member mounted on one of said docking station sidewalls.

3. The printer ink supply system according to claim 1, including a keying member mounted on one of said another docking station sidewalls.

4. The printer ink supply system according to claim 1, wherein said docking station includes a pair of separated keying members including at least one T-shaped keying member and at least one keying member receiver and said another docking station includes a pair of keying members including at least one T-shaped keying member and at least one keying member receiver.

5. The printer ink supply system according to claim 4, wherein said at least one T-shaped keying member is mounted on said docking station bottom wall and said at least one keying member receiver is mounted on said another docking station top wall.

6. The printer ink supply system according to claim 4, wherein said at least one T-shaped member includes a leg fixed at an end to a wall of said docking station, said leg having an elongated member fixed perpendicularly at an opposite end thereof.

7. The printer ink supply system according to claim 4, wherein said at least one T-shaped keying member is fixed to a top wall of said docking station.

8. The printer ink supply system according to claim 4, wherein said at least one keying member receiver includes an elongated channel member having lips for receipt of said at least one T-shaped keying member.

9. A printer ink supply system, comprising:

a docking station having a pair of separated keying members and a plurality of other docking stations, each one of said plurality of other docking stations having a pair of separated keying members, wherein said docking station and one or more of said plurality of other docking stations can be arranged in interlocked relationship when one of said pair of keying members on said docking station is connected to one of said pair of keying members on one of said plurality of other docking stations wherein said interlocked relationship comprises a stack of docking stations wherein said docking station is interlocked at a top wall to a bottom wall of one of said plurality of other docking stations.

10. The printer ink supply system according to claim 9, wherein said interlocked relationship includes a stack of docking stations wherein said docking station is interlocked at a sidewall to a sidewall of one of said plurality of other docking stations and said docking station is interlocked at an opposite sidewall to a sidewall of another one of said plurality of other docking stations.

11. The printer ink supply system according to claim 9, wherein said interlocked relationship comprises a collection of docking stations wherein said docking station is interlocked at a sidewall to a sidewall of one of said plurality of other docking stations and said docking station is interlocked at a top wall to a bottom wall of one of said plurality of other docking stations.

12. The printer ink supply system according to claim 9, wherein said interlocked relationship comprises a collection of docking stations wherein said docking station is interlocked at a sidewall to a sidewall of one of said plurality of other docking stations and said docking station is interlocked at a bottom wall to a top wall of one of said plurality of other docking stations.

13. A method of arranging a plurality of printer ink supply docking stations in stacked relationship, comprising the steps of:

providing a docking station, said docking station including a bottom having a keying member;

providing another docking station, said another docking station including a top wall having a keying member receiver; and interlocking said docking station keying member with said another docking station keying member receiver.

* * * * *